US007725310B2

(12) United States Patent
Den Brinker et al.

(10) Patent No.: US 7,725,310 B2
(45) Date of Patent: May 25, 2010

(54) AUDIO ENCODING

(75) Inventors: Albertus Cornelis Den Brinker, Eindhoven (NL); Andreas Johannes Gerrits, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 896 days.

(21) Appl. No.: 10/575,428

(22) PCT Filed: Oct. 4, 2004

(86) PCT No.: PCT/IB2004/051963

§ 371 (c)(1),
(2), (4) Date: Apr. 10, 2006

(87) PCT Pub. No.: WO2005/036529

PCT Pub. Date: Apr. 21, 2005

(65) Prior Publication Data

US 2007/0100639 A1 May 3, 2007

(30) Foreign Application Priority Data

Oct. 13, 2003 (EP) ..... 03103774

(51) Int. Cl.
*G10L 19/00* (2006.01)

(52) U.S. Cl. ..... 704/219; 704/221; 704/222; 704/500

(58) Field of Classification Search ..... 704/219, 704/221, 222, 500
See application file for complete search history.

(56) References Cited

U.S. PATENT DOCUMENTS 4,937,873 A * 6/1990 McAulay et al. ..... 704/265
6,292,777 B1 * 9/2001 Inoue et al. ..... 704/230
2002/0007268 A1 * 1/2002 Oomen et al. ..... 704/206
2003/0135374 A1 * 7/2003 Hardwick ..... 704/264
2004/0039568 A1 * 2/2004 Toyama et al. ..... 704/229

(Continued)

FOREIGN PATENT DOCUMENTS

DE 4229372 A1 3/1994

(Continued)

OTHER PUBLICATIONS

Pan, Davis Yen "Digital Audio Compression" Digital Technical Journal USA, vol. 5, No. 2, 1993, pp. 28-40.

(Continued)

*Primary Examiner*—Daniel D Abebe

(57) ABSTRACT

Coding of an audio signal (x) represented by a respective set of sampled signal values (x(t)) for each of a plurality of sequential time segments is disclosed. The sampled signal values are analyzed to determine one or more sinusoidal components for each of the plurality of sequential segments. The sinusoidal components are linked across a plurality of sequential segments to provide sinusoidal tracks, where each track comprises a number of frames. An encoded signal (AS) is generated, including sinusoidal codes ($C_s$) comprising a representation level (r) for each frame or including sinusoidal codes ($C_s$) where some of these codes comprise a phase ($\phi$), a frequency ($\omega$) and a quantization table (Q) for a given frame when the given frame is designated as a random-access frame. The invention allows random access in a track while avoiding long adaptation of the quantization accuracy in a quantizer and/or the need for a large bit stream while still maintaining improved audio quality.

11 Claims, 4 Drawing Sheets

U.S. PATENT DOCUMENTS

| | | | | |
|---|---|---|---|---|
| 2007/0005349 | A1* | 1/2007 | Absar et al. | 704/203 |
| 2008/0082325 | A1* | 4/2008 | Tsuji et al. | 704/225 |

FOREIGN PATENT DOCUMENTS

| | | | |
|---|---|---|---|
| WO | 01/69593 | A1 | 9/2001 |
| WO | 01/89086 | A1 | 11/2001 |
| WO | 2004/051627 | A1 | 6/2004 |

OTHER PUBLICATIONS

Den Brinker, A.C. et al "Parametric Coding for High-Quality Audio" Preprints of Papers Presented at the AES Convention, May 10, 2002, pp. 1-10.

Liebchen, Tilman "MPEG-4 Lossless Coding for High-Definition Audio" Audio Engineering Society Convention Paper, Oct. 10, 2003, pp. 1-6.

Den Brinker, A.C. et al "Phase Transmission in a Sinusoidal Audio and Speech Coder" Audio Engineering Society Convention Paper 5983, Oct. 10, 2003, pp. 1-7.

* cited by examiner

Fig. 7a - PRIOR ART

AUDIO ENCODING

FIELD OF THE INVENTION

The present invention relates to encoding and decoding of broadband signals, in particular audio signals. The invention relates both to the encoder and the decoder, and to an audio stream encoded according to the invention and a data storage medium on which such an audio stream has been stored.

BACKGROUND OF THE INVENTION

When transmitting broadband signals, e.g. audio signals such as speech, compression or encoding techniques are used to reduce the bandwidth or bit rate of the signal.

FIG. 1 shows a known parametric encoding scheme, in particular a sinusoidal encoder, which is used in the present invention, and which is described in WO 01/69593 and European Patent Application 02080002.5 (PHNL021216). In this encoder, an input audio signal x(t) is split into several (possibly overlapping) time segments or frames, typically having a duration of 20 ms each. Each segment is decomposed into transient, sinusoidal and noise components. It is also possible to derive other components of the input audio signal such as harmonic complexes, although these are not relevant for the purposes of the present invention.

In the sinusoidal analyser 130 of FIG. 1, the signal x2 for each segment is modeled by using a number of sinusoids represented by amplitude, frequency and phase parameters. This information is usually extracted for an analysis time interval by performing a Fourier transform (FT) which provides a spectral representation of the interval including: frequencies, amplitudes for each frequency, and phases for each frequency, where each phase is "wrapped", i.e. in the range $\{-\pi;\pi\}$. Once the sinusoidal information for a segment is estimated, a tracking algorithm is initiated. This algorithm uses a cost function to link sinusoids in different segments with each other on a segment-to-segment basis to obtain so-called tracks. The tracking algorithm thus results in sinusoidal codes $C_S$ comprising sinusoidal tracks that start at a specific time instance, evolve for a certain period of time over a plurality of time segments and then stop.

In such sinusoidal encoding, it is usual to transmit frequency information for the tracks formed in the encoder. This can be done in a simple manner and with relatively low costs, because tracks only have a slowly varying frequency. Frequency information can therefore be transmitted efficiently by time-differential encoding. In general, amplitude can also be encoded differentially over time.

In contrast to frequency, phase changes more rapidly with time. If the frequency is (substantially) constant, the phase will change (substantially) linearly with time, and frequency changes will result in corresponding phase deviations from the linear course. As a function of the track segment index, phase will have an approximately linear behavior. Transmission of encoded phase is therefore more complicated. However, when transmitted, phase is limited to the range $\{-\pi;\pi\}$, i.e. the phase is "wrapped", as provided by the Fourier transform. Because of this modulo $2\pi$ representation of phase, the structural inter-frame relation of the phase is lost and, at first sight, appears to be a random variable.

However, since the phase is the integral of the frequency, the phase is redundant and, in principle, does not need to be transmitted. This reduces the bit rate significantly. In the decoder, the phase is recovered by a process which is called phase continuation.

In phase continuation, only the encoded frequency is transmitted, and the phase is recovered at the decoder from the frequency data by exploiting the integral relation between phase and frequency. It is known, however, that when phase continuation is used, the phase cannot be perfectly recovered. If frequency errors occur, e.g. due to measurement errors in the frequency or due to quantization noise, the phase, which is being reconstructed by using the integral relation, will typically show an error having the character of drift. This is because frequency errors have an approximately random character. Low-frequency errors are amplified by integration, and consequently the recovered phase will tend to drift away from the actually measured phase. This leads to audible artifacts.

This is illustrated in FIG. 2*a* where $\Omega$ and $\psi$ are the real frequency and real phase, respectively, for a track. In both the encoder and decoder, frequency and phase have an integral relationship as represented by the letter "I". The quantization process in the encoder is modeled as added noise n. In the decoder, the recovered phase $\hat{\psi}$ thus includes two components: the real phase $\psi$ and a noise component $\epsilon_2$, where both the spectrum of the recovered phase and the power spectral density function of the noise $\epsilon_2$ have a pronounced low-frequency character.

Thus, it can be seen that in phase continuation, the recovered phase is a low-frequency signal itself because the recovered phase is the integral of a low-frequency signal. However, the noise introduced in the reconstruction process is also dominant in this low-frequency range. It is therefore difficult to separate these sources with a view to filtering the noise n introduced during encoding.

Furthermore, in phase continuation, only the first sinusoid of each track is transmitted for each track in order to save bit rate. Each subsequent phase is calculated from the initial phase and frequencies of the track. Since the frequencies are quantized and not always estimated very accurately, the continuous phase will deviate from the measured phase. Experiments show that phase continuation degrades the quality of an audio signal.

European Patent Application 02080002.5 (PHNL021216) addresses these problems by proposing a joint frequency/phase quantizer, where the measured phases of a sinusoidal track, which have values between $-\pi$ and $\pi$, are unwrapped by using the measured frequencies and linking information, resulting in monotonic increasing unwrapped phases along a track. In the encoder, the unwrapped phases are quantized by using an Adaptive Differential Pulse Code Modulation (ADPCM) quantizer and transmitted to the decoder. The decoder derives the frequencies and the phases of a sinusoidal track from the unwrapped phase trajectory.

As an example, the ADPCM quantizer can be configured as described below. For the first continuation of a track, the unwrapped phase is quantized in accordance with Table 1.

TABLE 1

Representation table R used for first continuation.

| Representation level r | Representation table R | Level type |
|---|---|---|
| 0 | −3.0 | Outer level |
| 1 | −0.75 | Inner level |
| 2 | 0.75 | Inner level |
| 3 | 3.0 | Outer level |

The quantization boundaries are defined in accordance with this table by: $\{-\infty; 2\cdot T\ (r=1), 0, 2\cdot T\ (r=2), \infty\}$. For each consecutive continuation, the tables are scaled. If the representation level is in the outer level, the tables are multiplied by $2^{1/2}$, making the quantization accuracy coarser. Otherwise, the representation levels are in the inner level and the tables are scaled by $2^{-1/4}$, making the quantization accuracy finer. Furthermore, there is an upper and lower boundary to the inner level, namely $3\pi/4$ and $\pi/64$.

The quantization of the unwrapped phase trajectory is a continuous process in the above methods, where the quantization accuracy is adapted along the track. Therefore, in order to decode a track, the decoding process has to start from the birth or starting point of a track, i.e. the decoder can only de-quantize a complete track and it is not possible to decode a part of the track. Therefore, special methods enabling random-access have to be added to the encoder and decoder. Random-access may e.g. be used to 'skip' or 'fast forward' in an audio signal.

A first straightforward way of performing random access is to define random-access frames (or refresh points) in the encoder/quantizer and re-start the ADPCM quantizer in the decoder at these random-access frames. For the random-access frame, the initial tables are used. Therefore, refreshes are as expensive in bits as normal births. However, a drawback of this approach is that the quantization tables and thus the quantization accuracy have to be adapted again from the random-access frame and onwards. Therefore, initially, the quantization accuracy might be too coarse, resulting in a discontinuity in the track, or too fine, resulting in large quantization errors. This leads to a degradation of the audio quality compared to the decoded signals without the use of random-access frames.

A second straightforward way is to transmit all states of the ADPCM quantizer (that is the quantization accuracy and the memories in the predictor as mentioned in European Patent Application 02080002.5 (PHNL021216). The quantizer will then have similar output with or without random-access frames. In this way, the sound quality will hardly suffer. However, the additional bit rate to transmit all this information will be considerable. Especially since the contents of the memories of the predictor have to be quantized according to the quantization accuracy of the ADPCM quantizer.

The present invention addresses these problems.

SUMMARY OF THE INVENTION

The present invention provides a method of encoding a broadband signal, in particular an audio signal or a speech signal, using a low bit rate. More specifically, the invention provides a method of encoding an audio signal, the method comprising the steps of: providing a respective set of sampled signal values for each of a plurality of sequential time segments; analyzing the sampled signal values to determine one or more sinusoidal components for each of the plurality of sequential segments; linking sinusoidal components across a plurality of sequential segments to provide sinusoidal tracks, each track comprising a number of frames; and generating an encoded signal including sinusoidal codes comprising a representation level for zero or more frames and where some of these codes comprise a phase, a frequency and a quantization table for a given frame when the given frame is designated as a random-access frame.

In this way, random-access is enabled, e.g. allowing skipping through a track, etc., while avoiding the long adaptation of the quantization accuracy in a quantizer, e.g. an ADPCM quantizer, of the prior art, as (some) of the quantization state is transmitted (in the form of the quantization table) to the encoder.

Furthermore, the quantization table is adapted to be faster as compared with the first straightforward method that uses the default initial table. Additionally, as compared with the second straightforward method, the present invention results in a lower bit rate.

The present invention offers a good compromise between the two (straightforward) methods, by transmitting only the quantization accuracy, thereby providing a good quality at a low bit rate.

In a preferred embodiment, each quantization table is represented by an index where the index is transmitted from the encoder to the decoder at a random-access frame instead of the quantization table. The index may e.g. be generated or represented by using Huffman coding.

Preferably, the phase ($\phi$) and the frequency ($\omega$) for a random-access frame are the measured phase and the measured frequency in the refresh frame quantized according to the default method used for quantising a starting point of a track. These phases and frequencies will also be referred to as $\phi(0)$ and $\omega(0)$, respectively.

BRIEF DESCRIPTION OF THE DRAWINGS

FIGS. 7*a* and 7*b* illustrate the information sent from the encoder and received at the decoder according to the prior art and to the present invention, respectively.

DESCRIPTION OF PREFERRED EMBODIMENTS

Figure 1:
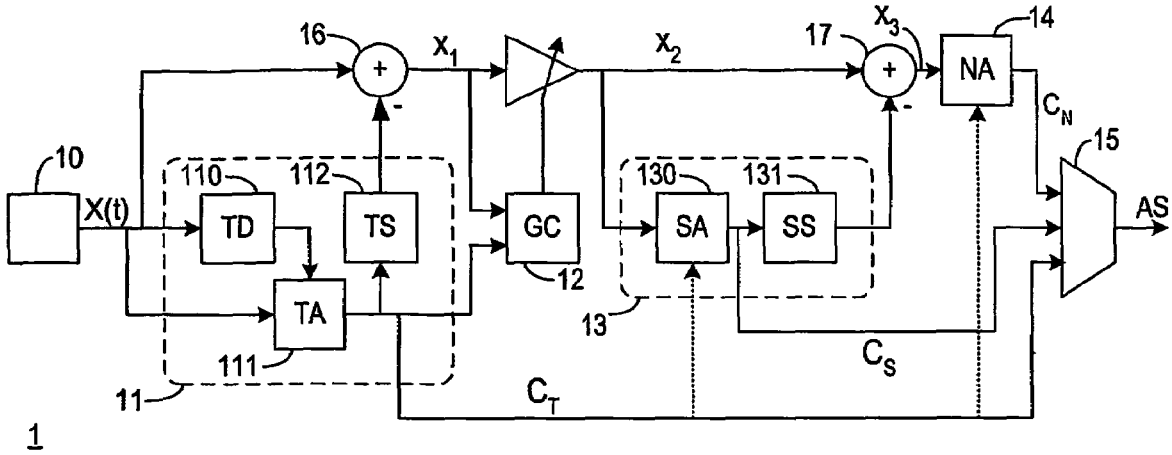
Fig. 1 - PRIOR ART
FIG. 1 shows a prior-art audio encoder in which an embodiment of the invention is implemented.

Preferred embodiments of the invention will now be described with reference to the accompanying drawings wherein like components have been accorded like reference numerals and, unless otherwise stated, perform like functions.

FIG. 1 shows a prior-art audio encoder 1 in which an embodiment of the invention is implemented. In a preferred embodiment of the present invention, the encoder I is a sinusoidal encoder of the type described in WO 01/69593, FIG. 1 and European Patent Application 02080002.5 (PHNL021216), FIG. 1. The operation of this prior-art encoder and its corresponding decoder has been well described and description is only provided here where relevant to the present invention.

In both the prior art and the preferred embodiment of the present invention, the audio encoder 1 samples an input audio signal at a certain sampling frequency, resulting in a digital representation x(t) of the audio signal. The encoder 1 then separates the sampled input signal into three components: transient signal components, sustained deterministic components, and sustained stochastic components. The audio encoder 1 comprises a transient encoder 11, a sinusoidal encoder 13 and a noise encoder (NA) 14.

The transient encoder 11 comprises a transient detector (TD) 110, a transient analyzer (TA) 111 and a transient synthesizer (TS) 112. First, the signal x(t) enters the transient detector 110. This detector 110 estimates if there is a transient signal component and its position. This information is fed to the transient analyzer (TA) 111. If the position of a transient signal component is determined, the transient analyzer (TA) 111 tries to extract (the main part of) the transient signal component It matches a shape function to a signal segment preferably starting at an estimated start position, and determines content underneath the shape function, by employing, for example, a (small) number of sinusoidal components. This information is contained in the transient code $C_T$, and more detailed information on generating the transient code $C_T$ is provided in WO 01/69593.

The transient code $C_T$ is furnished to the transient synthesizer (TS) 112. The synthesized transient signal component is subtracted from the input signal x(t) in subtractor 16, resulting in a signal x1. A gain control mechanism GC (12) is used to produce x2 from x1.

The signal x2 is furnished to the sinusoidal encoder 13 where it is analyzed in a sinusoidal analyzer (SA) 130, which determines the (deterministic) sinusoidal components. It will therefore be seen that, while the presence of the transient analyzer is desirable, it is not necessary and the invention can be implemented without such an analyzer. Alternatively, as mentioned above, the invention can also be implemented with, for example, a harmonic complex analyzer. In brief, the sinusoidal encoder encodes the input signal x2 as tracks of sinusoidal components linked from one frame segment to the next.

Figure 3A:
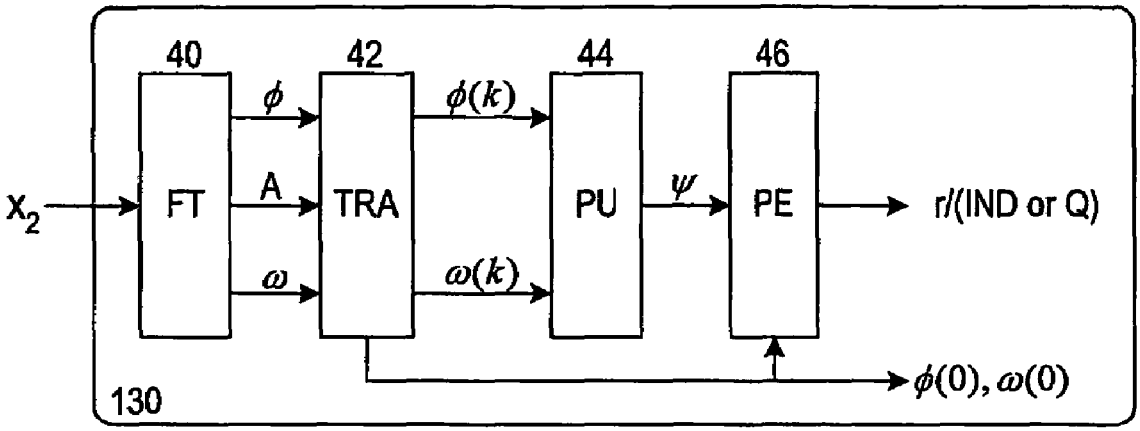
FIGS. 3*a* and 3*b* show a preferred embodiment of a sinusoidal encoder component of the audio encoder of FIG. 1 according to the present invention.

Referring now to FIG. 3*a*, in the same manner as in the prior art, in the preferred embodiment, each segment of the input signal x2 is transformed into the frequency domain in a Fourier transform (FT) unit 40. For each segment, the FT unit provides measured amplitudes A, phases $\phi$ and frequencies $\omega$. As mentioned previously, the range of phases provided by the Fourier transform is restricted to $-\pi \leqq \phi < \pi$. A tracking algorithm (TRA) unit 42 takes the information for each segment and by employing a suitable cost function, links sinusoids from one segment to the next, thus producing a sequence of measured phases $\phi(k)$ and frequencies $\omega(k)$ for each track.

The sinusoidal codes $C_S$ ultimately produced by the analyzer 130 include phase information, and frequency is reconstructed from this information in the decoder, as is mentioned in European Patent Application 02080002.5 (PHNL021216). According to the present invention, a quantization table (Q) or preferably an index (IND) representing the quantization table (Q) is produced by the analyzer 130 instead of a representation level r when the given sub-frame being processed is a random-access frame, as will be explained in greater detail with reference to FIG. 3*b*.

As mentioned above, however, the measured phase $\phi(k)$ is wrapped, which means that it is restricted to a modulo $2\pi$ representation. Therefore, in the preferred embodiment, the analyzer comprises a phase unwrapper (PU) 44 where the modulo $2\pi$ phase representation is unwrapped to expose the structural inter-frame phase behavior $\psi$ for a track. As the frequency in sinusoidal tracks is nearly constant it will be seen that the unwrapped phase $\psi$ will typically be a nearly linearly increasing (or decreasing) function and this makes cheap transmission of phase, i.e. with low bit rate, possible. The unwrapped phase $\psi$ is provided as input to a phase encoder (PE) 46, which provides, as output, quantized representation levels r suitable for being transmitted (when a given sub-frame is not a random-access frame).

Referring now to the operation of the phase unwrapper 44, as mentioned above, instantaneous phase $\psi$ and instantaneous frequency $\Omega$ for a track are related by:

$$\psi(t) = \int_{T_0}^{t} \Omega(\tau)d\tau + \psi(T_0) \tag{1}$$

where $T_0$ is a reference time instant.

A sinusoidal track in frames k=K, K+1 . . . K+L−1 has measured frequencies $\omega(k)$ (expressed in radians per second) and measured phases $\phi(k)$ (expressed in radians). The distance between the centres of the frames is given by U (update rate expressed in seconds). The measured frequencies are supposed to be samples of the assumed underlying continuous-time frequency track $\Omega$ with $\omega(k)=\Omega(kU)$ and, similarly, the measured phases are samples of the associated continuous-time phase track $\psi$ with $\phi(k)=\psi(kU) \bmod (2\pi)$. For sinusoidal encoding, it is assumed that $\Omega$ is a nearly constant function.

Assuming that the frequencies are nearly constant within a segment, Equation 1 can be approximated as follows:

$$\psi(kU) = \int_{(k-1)U}^{kU} \Omega(t)dt + \psi((k-1)U) \approx \{\omega(k) + \omega(k-1)\}U/2 + \psi((k-1)U) \tag{2}$$

It will therefore be seen that, knowing the phase and frequency for a given segment and the frequency of the next segment, it is possible to estimate an unwrapped phase value for the next segment, and so on for each segment in a track.

In the preferred embodiment, the phase unwrapper determines an unwrap factor m(k) at time instant k:

$$\psi(kU)=\phi(k)+m(k)2\pi \tag{3}$$

The unwrap factor m(k) tells the phase unwrapper 44 the number of cycles which has to be added to obtain the unwrapped phase.

Combining equations 2 and 3, the phase unwrapper determines an incremental unwrap factor e(k) as follows:

$$2\pi e(k)=2\pi\{m(k)-m(k-1)\}=\{\omega(k)+\omega(k-1)\}U/2-\{\phi(k)-\phi(k-1)\}$$

where e should be an integer. However, due to measurement and model errors, the incremental unwrap factor will not be an integer exactly, so:

$$e(k)=\mathrm{round}([\{\omega(k)+\omega(k-1)\}U/2-\{\phi(k)-\phi(k-1)\}]/(2\pi))$$

assuming that the model and measurement errors are small.

Having the incremental unwrap factor e, the m(k) from equation (3) is calculated as the cumulative sum where, without loss of generality, the phase unwrapper starts in the first frame K with m(K)=0, and from m(k) and $\phi(k)$, the (unwrapped) phase $\psi(kU)$ is determined.

In practice, the sampled data $\psi(kU)$ and $\Omega(kU)$ are distorted by measurement errors:

$$\phi(k)=\psi(kU)+\epsilon_1(k),$$

$$\omega(k)=\Omega(kU)+\epsilon_2(k),$$

where $\epsilon_1$ and $\epsilon_2$ are the phase and frequency errors, respectively. In order to prevent the determination of the unwrap factor becoming ambiguous, the measurement data needs to be determined with sufficient accuracy. Thus, in the preferred embodiment, tracking is restricted so that:

$$\delta(k)=e(k)-[\{\omega(k)+\omega(k-1)\}U/2-\{\phi(k)-\phi(k-1)\}]/(2\pi) < \delta_0$$

where $\delta$ is the error in the rounding operation. The error $\delta$ is mainly determined by the errors in $\omega$ due to the multiplication with U. Assume that $\omega$ is determined from the maxima of the absolute value of the Fourier transform from a sampled version of the input signal with sampling frequency $F_s$ and that the resolution of the Fourier transform is $2\pi/L_a$ with $L_a$ being the analysis size. In order to be within the considered bound, we have:

$$\frac{L_a}{U} = \delta_0$$

This means that the analysis size should be few times larger than the update size in order for unwrapping to be accurate, e.g., setting $\delta_0=1/4$, the analysis size should be four times the update size (neglecting the errors $\epsilon_1$ in the phase measurement).

The second precaution, which can be taken to avoid decision errors in the round operation, is to define tracks appropriately. In the tracking unit 42, sinusoidal tracks are typically defined by considering amplitude and frequency differences. Additionally, it is also possible to account for phase information in the linking criterion. For instance, we can define the phase prediction error e as the difference between the measured value and the predicted value $\tilde{\phi}$ according to $$\epsilon=\{\phi(k)-\tilde{\phi}(k)\}\bmod 2\pi$$

where the predicted value can be taken as $$\tilde{\phi}(k)=\phi(k-1)+\{\omega(k)-\omega(k-1)\}U/2$$

Thus, preferably the tracking unit (TRA) 42 forbids tracks where $\epsilon$ is larger than a certain value (e.g. $\epsilon>\pi/2$), resulting in an unambiguous definition of e(k).

Additionally, the encoder may calculate the phases and frequencies such as will be available in the decoder. If the phases or frequencies which will become available in the decoder differ too much from the phases and/or frequencies such as are present in the encoder, it may be decided to interrupt a track, i.e. to signal the end of a track and start a new one using the current frequency and phase and their linked sinusoidal data.

The sampled unwrapped phase $\psi(kU)$ produced by the phase unwrapper (PU) 44 is provided as input to phase encoder (PE) 46 to produce the set of representation levels r (or according to the present invention, a quantization table (Q) or an index (IND) representing the quantization table (Q) when the given sub-frame being processed/transmitted is a random-access frame. Techniques for efficient transmission of a generally monotonically changing characteristic such as the unwrapped phase are known.

Figure 3B:
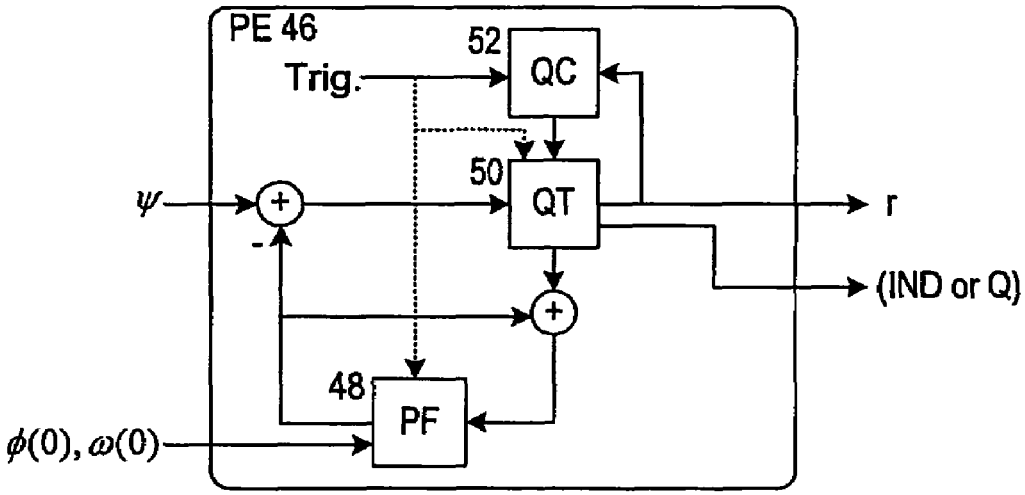

FIG. 3*b* illustrates a preferred embodiment of the phase encoder (PE) 46. In this preferred embodiment, Adaptive Differential Pulse Code Modulation (ADPCM) is employed. Here, a predictor (PF) 48 is used to estimate the phase of the next track segment and encode the difference only in a quantizer (QT) 50. Since $\psi$ is expected to be a nearly linear function and, also for reasons of simplicity, the predictor 48 is chosen as a second-order filter of the form:

$$y(k+1)=2x(k)-x(k-1)$$

where x is the input and y is the output. It will be seen, however, that it is also possible to take other functional relations (including higher-order relations) and to include (backward or forward) adaptation of the filter coefficients. In the preferred embodiment, a backward adaptive control mechanism (QC) 52 is used for simplicity to control the quantizer (QT) 50. Forward adaptive control is possible as well but would require extra bit rate.

Figure 5A:
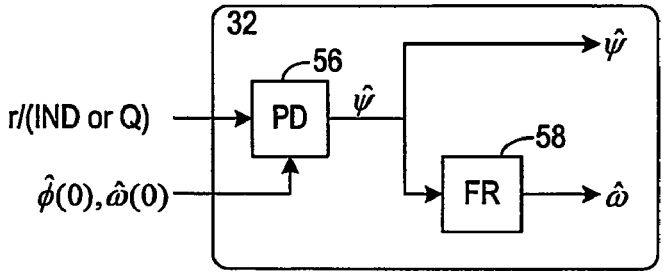
FIGS. 5*a* and 5*b* show a preferred embodiment of a sinusoidal synthesizer component of the audio player of FIG. 4 according to the present invention.
Figure 5B:
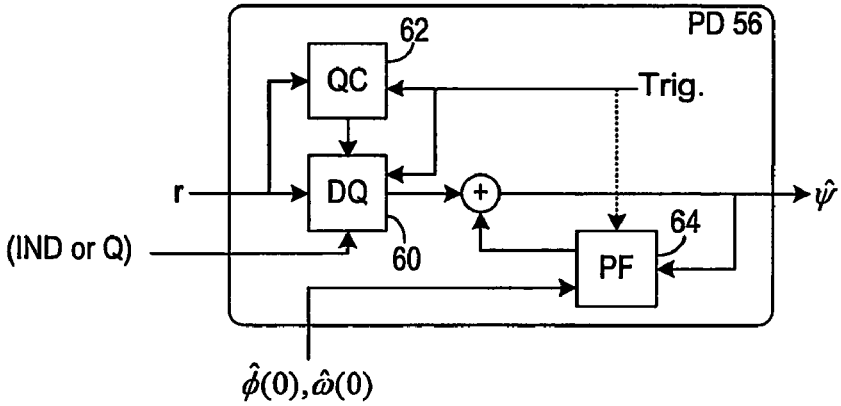

As will be seen, initialization of the encoder (and decoder) for a track starts with knowledge of the start phase $\phi(0)$ and frequency $\omega(0)$. These are quantized and transmitted by a separate mechanism. Additionally, the initial quantization step used in the quantization controller (QC) 52 of the encoder and the corresponding controller 62 in the decoder, FIG. 5*b*, is either transmitted or set to a certain value in both encoder and decoder. Finally, the end of a track can either be signaled in a separate side stream or as a unique symbol in the bit stream of the phases.

The start frequency of the unwrapped phase is known, both in the encoder and in the decoder. The quantization accuracy is chosen on the basis of this frequency. For the unwrapped phase trajectories beginning with a low frequency, a more accurate quantization grid, i.e. a higher resolution, is chosen than for an unwrapped phase trajectory beginning with a higher frequency.

In the ADPCM quantizer, the unwrapped phase $\psi(k)$, where k represents the number in the track, is predicted/estimated from the preceding phases in the track. The difference between the predicted phase $\tilde{\psi}(k)$ and the unwrapped phase $\psi(k)$ is then quantized and transmitted. The quantizer is adapted for every unwrapped phase in the track. When the prediction error is small, the quantizer limits the range of possible values and the quantization can become more accurate. On the other hand, when the prediction error is large, the quantizer uses a coarser quantization.

The quantizer Q in FIG. 3*b* quantizes the prediction error $\Delta$, which is calculated by $$\Delta(k)=\psi(k)-\tilde{\psi}(k)$$

The prediction error A can be quantized by using a look-up table. For this purpose, a table Q is maintained. For example, for a 2-bit ADPCM quantizer, the initial table for Q may look like the table shown in Table 2.

TABLE 2

Quantization table Q used for first continuation.

| Index i | Lower boundaries bl | Upper boundary bu |
|---|---|---|
| 0 | $-\infty$ | −1.5 |
| 1 | −1.5 | 0 |
| 2 | 0 | 1.5 |
| 3 | 1.5 | $\infty$ |

The quantization is done as follows. The prediction error $\Delta$ is compared with the boundaries b, such that the following equation is satisfied:

$$bl_i<\Delta\leq bu_i$$

From the value of i, which satisfies the above relation, the representation level r is computed by r=i.

The associated representation levels are stored in representation table R, which is shown in Table 3.

TABLE 3

Representation table R used for first continuation

| Representation level r | Representation table R | Level type |
|---|---|---|
| 0 | −3.0 | Outer level |
| 1 | −0.75 | Inner level |

TABLE 3-continued

Representation table R used for first continuation

| Representation level r | Representation table R | Level type |
|---|---|---|
| 2 | 0.75 | Inner level |
| 3 | 3.0 | Outer level |

The entries of tables Q and R are multiplied by a factor c for the quantization of the next sinusoidal component in the track.

$$Q(k+1)=Q(k)\cdot c$$

$$R(k+1)=R(k)\cdot c$$

During the decoding of a track, both tables are scaled in accordance with the generated representation levels r. If r is either 1 or 2 (inner level) for the current sub-frame, then the scale factor c for the quantization table is set to $$c=2^{-1/4}$$

Since c<1, the frequency and phase of the next sinusoid in a track become more accurate. If r is 0 or 3 (outer level), the scale factor is set to $$c=2^{1/2}$$

Since c>1, the quantization accuracy for the next sinusoid in a track decreases. Using these factors, one up-scaling can be made undone by two down-scalings. The difference in upscale and downscale factors results in a fast onset of an up-scaling, whereas a corresponding downscaling requires two steps.

In order to avoid very small or very large entries in the quantization table, the adaptation is only done if the absolute value of the inner level is between $\pi/64$ and $3\pi/4$. In case the inner level is less than or equal to $\pi/64$ or greater than or equal to $3\pi/4$ the scale factor c is set to 1.

In the decoder, only table R has to be maintained to convert the received representation levels r to a quantized prediction error. This de-quantization operation is performed by block (DQ) 60 in FIG. 5*b*.

Using the above settings, the quality of the reconstructed sound needs improvement. Different initial tables for unwrapped phase tracks, depending on the start frequency, may be used. This yields a better sound quality. This is done as follows. The initial tables Q and R are scaled on the basis of a first frequency of the track. In Table 4, the scale factors are given together with the frequency ranges. If the first frequency of a track lies in a certain frequency range, the appropriate scale factor is selected, and the tables R and Q are divided by that scale factor. The end-points may also depend on the first frequency of the track. In the decoder, a corresponding procedure is performed in order to start with the correct initial table R.

TABLE 4

Frequency-dependent scale factors and initial tables

| Frequency range | Scale factor | Initial table Q | Initial table R |
|---|---|---|---|
| 0–500 Hz | 8 | −∞ −0.19 0 0.19 ∞ | −0.375 −0.09375 0.09375 0.375 |
| 500–1000 Hz | 4 | −∞ −0.375 0 0.375 ∞ | −0.75 −0.1875 0.1875 0.75 |
| 1000–4000 Hz | 2 | −∞ −0.75 0 0.75 ∞ | −1.5 −0.375 0.375 1.5 |
| 4000–22050 Hz | 1 | −∞ −1.5 0 1.5 ∞ | −3 −0.75 0.75 3 |

Table 4 shows an example of frequency-dependent scale factors and corresponding initial tables Q and R for a 2-bit ADPCM quantizer. The audio frequency range 0-22050 Hz is divided into four frequency sub-ranges. It can be seen that the phase accuracy is improved in the lower frequency ranges relative to the higher frequency ranges.

The number of frequency sub-ranges and the frequency-dependent scale factors may vary and can be chosen to fit the individual purpose and requirements. As described above, the frequency-dependent initial tables Q and R in table 4 may be upscaled and down-scaled dynamically to adapt to the evolution in phase from one time segment to the next.

In e.g. a 3-bit ADPCM quantizer, the initial boundaries of the eight quantization intervals defined by the 3 bits can be defined as follows:

Q={−∞−1.41 −0.707 −0.35 0 0.35 0.707 1.41 ∞}, and can have minimum grid size $\pi/64$, and a maximum grid size $\pi/2$. The representation table R may look like:

R={−2.117, −1.0585, −0.5285, −0.1750, 0.1750, 0.5285, 1.0585, 2.117}. A similar frequency-dependent initialization of the table Q and R as shown in Table 4 may be used in this case.

So far, the process has been described in the same way as in European Patent Application 02080002.5 (PHNL021216).

According to the present invention, quantizer (QT) 50, predictor (PF) 48 and backward adaptive control mechanism (QC) 52 may further receive a (external) trigger signal (Trig.) indicating that the given frame being processed is a random-access frame. When no trigger signal (Trig.) is received, the process functions normally and only representation levels r are transmitted to the decoder. When a trigger (Trig.) is received (signifying a random-access frame), no representation levels r are transmitted but, instead, the quantization table (Q) or an index (IND) representing the quantization table (Q) is transmitted, together with the current phase ($\phi(0)$) and the current frequency ($\omega 0$)).

By proper setting of the quantizer parameters, only a limited number of quantization tables are possible. For the example given in Table 1, there are only 22 possible quantization tables, which are listed below in Table 5 together with an index number. The entries in Table 5 are rounded values of $$1.5 \cdot 2^{\frac{k}{4}},$$

where k ranges from −23, −22, . . . , 5, 6.

TABLE 5

Quantization tables at random-access frames

| Index | $T_1$ | $T_2$ | $T_3$ | $T_4$ |
|---|---|---|---|---|
| 0 | −4.2426 | −1.0607 | 1.0607 | 4.2426 |
| 1 | −3.5676 | −0.8919 | 0.8919 | 3.5676 |
| 2 | −3.0000 | −0.7500 | 0.7500 | 3.0000 |
| 3 | −2.5227 | −0.6307 | 0.6307 | 2.5227 |
| 4 | −2.1213 | −0.5303 | 0.5303 | 2.1213 |
| 5 | −1.7838 | −0.4460 | 0.4460 | 1.7838 |
| 6 | −1.5000 | −0.3750 | 0.3750 | 1.5000 |
| 7 | −1.2613 | −0.3153 | 0.3153 | 1.2613 |
| 8 | −1.0607 | −0.2652 | 0.2652 | 1.0607 |
| 9 | −0.8919 | −0.2230 | 0.2230 | 0.8919 |
| 10 | −0.7500 | −0.1875 | 0.1875 | 0.7500 |
| 11 | −0.6307 | −0.1577 | 0.1577 | 0.6307 |
| 12 | −0.5303 | −0.1326 | 0.1326 | 0.5303 |
| 13 | −0.4460 | −0.1115 | 0.1115 | 0.4460 |
| 14 | −0.3750 | −0.0938 | 0.0938 | 0.3750 |
| 15 | −0.3153 | −0.0788 | 0.0788 | 0.3153 |
| 16 | −0.2652 | −0.0663 | 0.0663 | 0.2652 |
| 17 | −0.2230 | −0.0557 | 0.0557 | 0.2230 |
| 18 | −0.1875 | −0.0469 | 0.0469 | 0.1875 |
| 19 | −0.1577 | −0.0394 | 0.0394 | 0.1577 |
| 20 | −0.1326 | −0.0331 | 0.0331 | 0.1326 |
| 21 | −0.1115 | −0.0279 | 0.0279 | 0.1115 |

Consequently, in a preferred embodiment, in order to reduce the amount of data transmitted, only an index representing/identifying/indicating the given quantization table (Q) is transmitted to the encoder where the index is used to retrieve the appropriate quantization table used as the initial table, which is explained in greater detail with reference to FIG. 5*b*.

Preferably, an index is generated by using the well-known Huffman coding. For table 5, such a Huffman coding-based index may be as listed in table 6 below:

TABLE 6

Huffman Index (IND) for quantization tables

| Index | IND |
|---|---|
| 0 | 100001 |
| 1 | 11101 |
| 2 | 11110 |
| 3 | 1100 |
| 4 | 1101 |
| 5 | 1010 |
| 6 | 0111 |
| 7 | 001 |
| 8 | 1011 |
| 9 | 0110 |
| 10 | 1001 |
| 11 | 0101 |
| 12 | 0000 |
| 13 | 0001 |
| 14 | 11100 |
| 15 | 01001 |
| 16 | 111111 |
| 17 | 111110 |
| 18 | 100000 |
| 19 | 010001 |

TABLE 6-continued

Huffman Index (IND) for quantization tables

| Index | IND |
|---|---|
| 20 | 010000 |
| 21 | 10001 |

In a preferred embodiment, instead of sending a given quantization table or quantization state (e.g. 19:$T_1$=−0.1577; $T_2$=−0.0394; $T_3$=0.0394; $T_4$=0.1577), only the index (IND) (e.g. 010001) is transmitted, thereby saving bit rate. This index is then used at the decoder to retrieve the proper quantization table (e.g. 19), which is then used according to the present invention.

In this way, random-access is enabled while avoiding long adaptation for high accuracy in the quantizer, because no re-starting of the quantizer is needed as the current accuracy of the quantization table is stored and transmitted to the decoder (either directly, by transmitting the given quantization table (Q), or indirectly, by transmitting an index (IND) referencing/uniquely identifying/indicating the given quantization table (Q). Furthermore, the quantization table is adapted to be faster and/or a lower bit rate is obtained.

Random-access frames may e.g. be selected or identified by selecting every N'th frame during a track, using audio analysis to select appropriate points, etc. For each random-access frame, the trigger signal is provided to the quantizer (QT) 50 (and (PF) 48 and (QC) 52) when a random-access frame is being processed.

From the sinusoidal code Cs generated with the sinusoidal encoder, the sinusoidal signal component is reconstructed by a sinusoidal synthesizer (SS) 131 in the same manner as will be described for the sinusoidal synthesizer (SS) 32 of the decoder. This signal is subtracted in subtractor 17 from the input x2 to the sinusoidal encoder 13, resulting in a residual signal x3. The residual signal x3 produced by the sinusoidal encoder 13 is passed to the noise analyzer 14 of the preferred embodiment which produces a noise code $C_N$ representative of this noise, as described in, for example, international patent application No. PCT/EP00/04599.

Finally, in a multiplexer 15, an audio stream AS is constituted which includes the codes $C_T$, $C_S$ and $C_N$. The audio stream AS is furnished to e.g. a data bus, an antenna system, a storage medium, etc.

Figure 4:
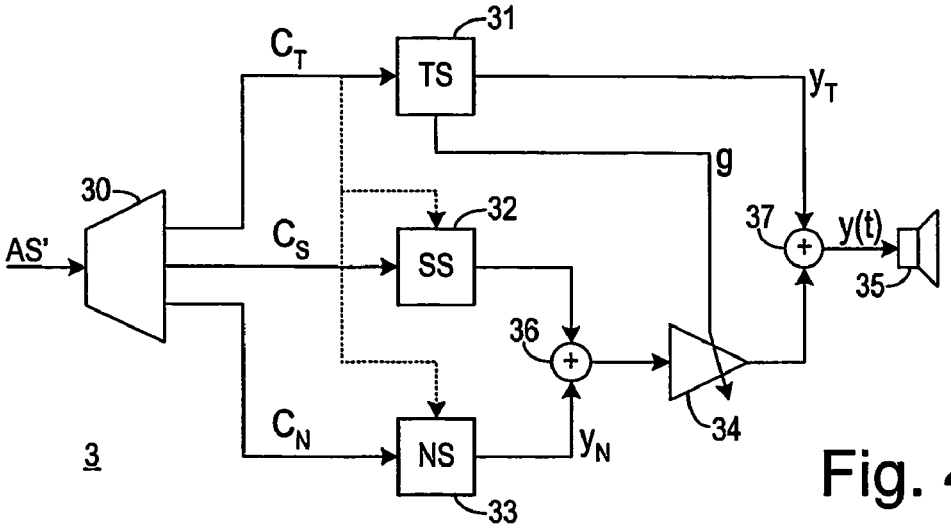
FIG. 4 shows an audio player in which an embodiment of the invention is implemented.

FIG. 4 shows an audio player 3 which is suitable for decoding an audio stream AS', e.g. generated by an encoder 1 of FIG. 1, obtained from a data bus, antenna system, storage medium, etc. The audio stream AS' is de-multiplexed in a de-multiplexer 30 to obtain the codes $C_T$, $C_S$ and $C_N$. These codes are furnished to a transient synthesizer (TS) 31, a sinusoidal synthesizer (SS) 32 and a noise synthesizer (NS) 33, respectively. From the transient code $C_T$, the transient signal components are calculated in the transient synthesizer (TS) 31. If the transient code indicates a shape function, the shape is calculated on the basis of the received parameters. Furthermore, the shape content is calculated on the basis of the frequencies and amplitudes of the sinusoidal components. If the transient code $C_T$ indicates a step, no transient is calculated. The total transient signal $y_T$ is a sum of all transients.

The sinusoidal code $C_S$ including the information encoded by the analyzer 130 is used by the sinusoidal synthesizer 32 to generate signal $y_S$. Referring now to FIGS. 5*a* and b, the sinusoidal synthesizer 32 comprises a phase decoder (PD) 56 which is compatible with the phase encoder 46. Here, a de-quantizer (DQ) 60 in conjunction with a second-order prediction filter (PF) 64 produces (an estimate of) the unwrapped phase $\hat{\psi}$ from: the representation levels r; current information $\phi(0)$, $\omega(0)$ provided to the prediction filter (PF) 64 and the initial quantization step for the quantization controller (QC) 62. If the frame is a random-access frame, the quantization table (Q), received from the encoder instead of the representation levels r, is used in the de-quantizer (DQ) 60 as the initial table, as will be explained in greater detail hereinafter.

Figure 2A:
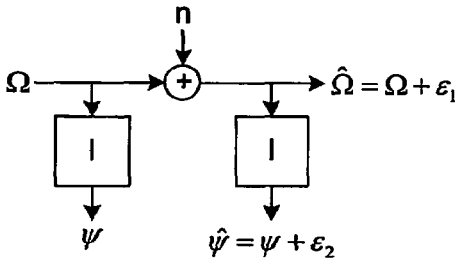
FIG. 2*a* illustrates the relationship between phase and frequency in prior-art systems.
Figure 2B:
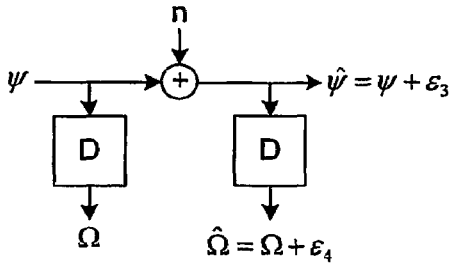
FIG. 2*b* illustrates the relationship between phase and frequency in audio systems using phase encoding.

As illustrated in FIG. 2*b*, the frequency can be recovered from the unwrapped phase $\hat{\psi}$ by differentiation. Assuming that the phase error at the decoder is approximately white, and since differentiation amplifies the high frequencies, the differentiation can be combined with a low-pass filter to reduce the noise and, thus, to obtain an accurate estimate of the frequency at the decoder.

In the preferred embodiment, a filtering unit (FR) 58 approximates the differentiation, which is necessary to obtain the frequency $\hat{\omega}$ from the unwrapped phase by procedures as forward, backward or central differences. This enables the decoder to produce as output the phases $\hat{\psi}$ and frequencies $\hat{\omega}$ usable in a conventional manner to synthesize the sinusoidal component of the encoded signal.

At the same time, as the sinusoidal components of the signal are being synthesized, the noise code $C_N$ is fed to a noise synthesizer NS 33, which is mainly a filter, having a frequency response approximating the spectrum of the noise. The NS 33 generates reconstructed noise $y_N$ by filtering a white noise signal with the noise code $C_N$. The total signal y(t) comprises the sum of the transient signal $y_T$ and the product of any amplitude decompression (g) and the sum of the sinusoidal signal $y_S$ and the noise signal $y_N$. The audio player comprises two adders 36 and 37 to sum respective signals. The total signal is furnished to an output unit 35, which is e.g. a speaker.

According to the present invention, for random-access frames, the transmitted quantization table (Q) or an index (IND) is received from the encoder instead of the representation levels r. The indication that the received frame is a random-access frame may e.g. be implemented by adding an additional field in the bit stream syntax comprising the appropriate index e.g. as shown in Table 6, thereby identifying the specific quantization table (Q) to be used. The index is obtained from the Huffman code. This index indicates the table that is used for the ADPCM, as shown in Table 5. This table includes all possible quantization tables Q. The number depends on the up-scale and down-scale factors and the minimum and maximum values of the inner level. If the current frame is a random-access frame, meaning that sub-frame K includes, for each sinusoid in the sub-frame, the additional field of the bit stream syntax having a value of a Huffman code (supplied to (QC) 62, (DQ) 60 and (PF) 64 as the trigger signal (Trig.)). Furthermore, sub-frame K also includes the directly quantized amplitude, frequency and phase for each sinusoid as specified by the encoder. The field of the bit stream syntax is Huffman decoded and the appropriate table T is selected in accordance with Table 5. This table is then used for the de-quantizer (DQ) (60) in the next sub-frame (K+1). The prediction filter (PF) 64 is re-initialized for sub-frame K+1 in the same way as is done for the first continuation:

$$\psi_r(K-1)=\phi(K)-\omega(K)\cdot U,$$

where U is the update interval. Here $\phi$ is the phase and $\omega$ is the frequency transmitted in the sub-frame K. The decoding continues in the traditional fashion as described above.

Figure 6:
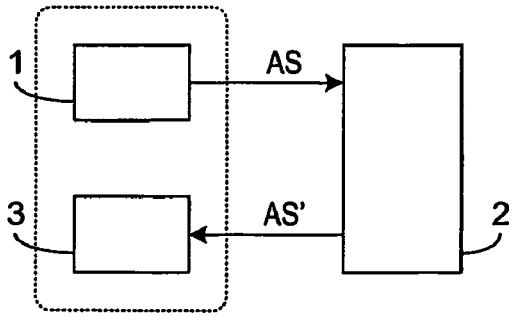
FIG. 6 shows a system comprising an audio encoder and an audio player according to the invention.

FIG. 6 shows an audio system according to the invention, comprising an audio encoder 1 as shown in FIG. 1 and an audio player 3 as shown in FIG. 4. Such a system offers playing and recording features. The audio stream AS is furnished from the audio encoder to the audio player via a communication channel 2, which may be a wireless connection, a data bus 20 or a storage medium. If the communication channel 2 is a storage medium, the storage medium may be fixed in the system or may also be a removable disc, a memory card or chip or other solid-state memory. The communication channel 2 may be part of the audio system, but will, however, often be outside the audio system.

Figure 7B:
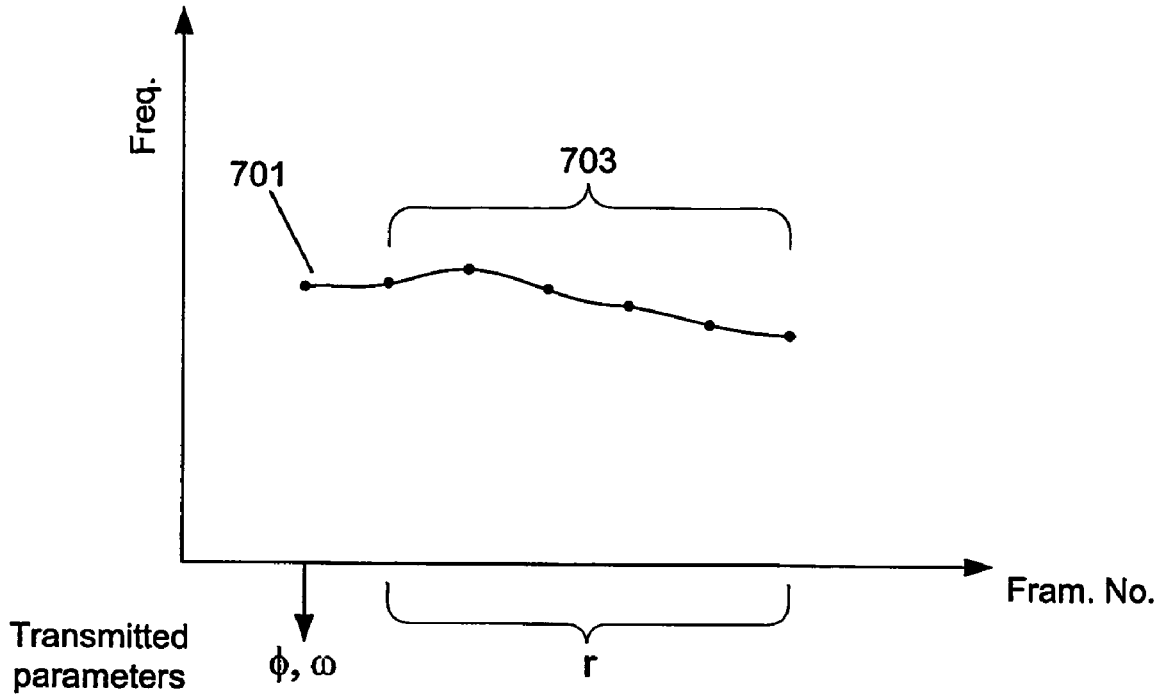
Figure 7B:
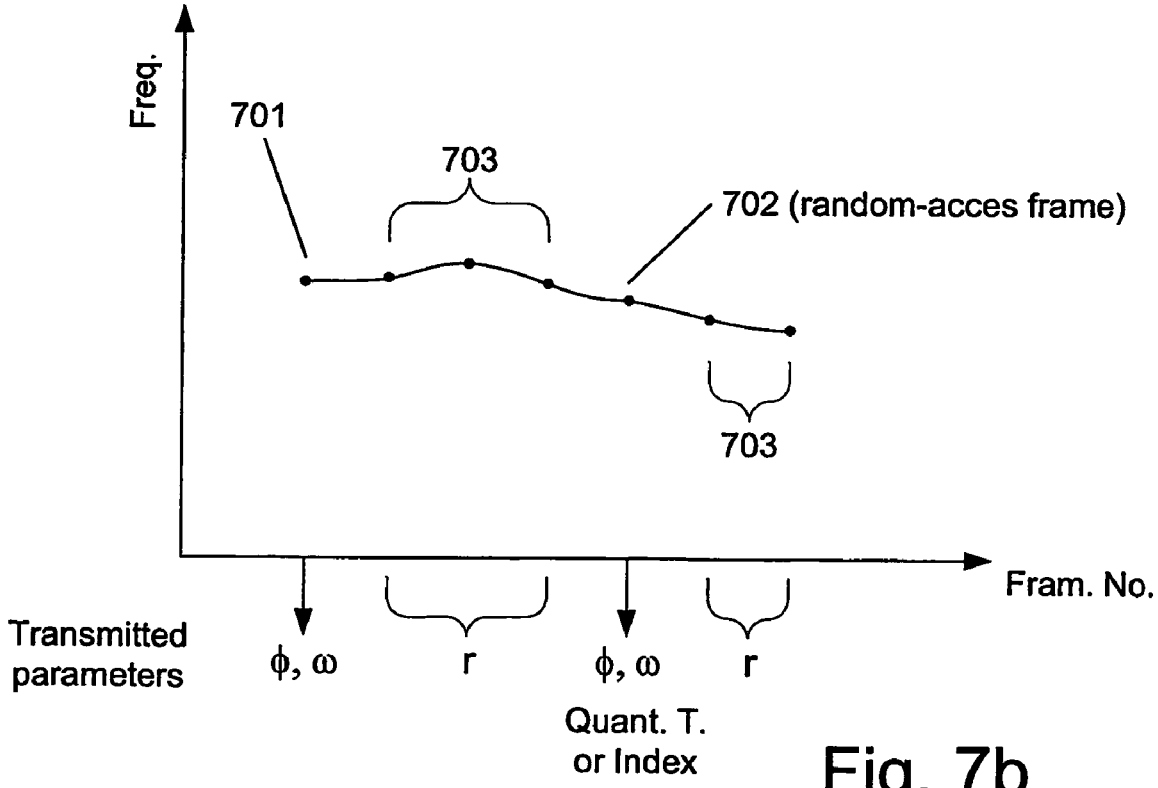

FIGS. 7*a* and 7*b* illustrate the information sent from the encoder and received at the decoder according to the prior art and to the present invention, respectively. FIG. 7*a* shows a number of frames (701; 703) with their frame number and frequency. The Figure further shows the information or parameters that are transmitted from an encoder to a decoder for each (sub-)frame according to the prior art. As can be seen, the initial phase ($\phi(0)$) and initial frequency ($\omega(0)$) are transmitted for the birth or start of track frame (701), while a representation level r is transmitted for each other frame (703) belonging to the track.

FIG. 7*b* illustrates a number of frames (701, 702, 703) shown with their frame number and frequency according to the present invention, as well as the information or parameters that are transmitted from an encoder to a decoder for each (sub-)frame. As can be seen, the initial phase ($\phi(0)$) and initial frequency ($\omega(0)$) are transmitted for the birth or start of track frame (701), similarly as in FIG. 7*a*, while a representation level r is transmitted for each other frame (703) belonging to the track, except for a random-access frame (702). For the random-access frame (702), the current phase ($\phi(0)$) and current frequency ($\omega(0)$) are transmitted from the encoder to the decoder together with the relevant quantization table (Q) (or an index, as explained before). In this way, at least some of the quantization state is transmitted from the encoder to the decoder, thereby avoiding audible artifacts, as explained before while not enlarging the required bit rate too much.

The invention claimed is:

1. A method of encoding an audio signal, the method comprising the steps of:

providing a respective set of sampled signal values (x(t)) for each of a plurality of sequential time segments;

analyzing the sampled signal values (x(t)) to determine one or more sinusoidal components for each of the plurality of sequential segments;

linking sinusoidal components across a plurality of sequential segments to provide sinusoidal tracks, each track comprising a number of frames; and generating an encoded signal (AS) including sinusoidal codes ($C_s$) comprising a representation level (r) for zero or more frames and where some of these codes ($C_s$) comprise a phase ($\phi$), a frequency ($\omega$) and a quantization table (Q) for a given frame when the given frame is designated as a random-access frame, wherein each quantization table (Q) is represented by an index (IND) and where the index (IND) is transmitted from an encoder to a decoder at a random-access frame instead of transmitting the quantization table (Q).

2. A method as claimed in claim 1, wherein a selection between a code for a frame comprising a representation level (r) and a code for a frame comprising a phase ($\phi$), a frequency ($\omega$) and a quantization table (Q) is made in dependence upon a trigger signal (Trig.).

3. A method as claimed in claim 1, wherein the index (IND) is generated or represented, using Huffman coding.

4. A method as claimed in claim 1, wherein the phase ($\phi$) and the frequency ($\omega$) for a random-access frame is the current phase ($\phi(0)$) and the current frequency ($\omega(0)$.

5. A method of decoding an encoded audio stream (AS'), the method comprising the steps of:

receiving a signal including the encoded audio stream (AS'), the audio stream (AS') comprising tracks of sinusoidal codes ($C_s$), where the sinusoidal codes ($C_s$) comprises a representation level (r) for zero or more frames and where some of these codes ($C_s$) comprise a phase ($\phi$), a frequency ($\omega$) and a quantization table (Q) for a given frame when the given frame is designated as a random-access frame, wherein each quantization table (Q) is represented by an index (IND) and where the index (IND) is transmitted from an encoder to a decoder at a random-access frame instead of transmitting the quantization table (Q).

6. A method as claimed in claim 5, wherein the index (IND) is generated or represented, using Huffman coding.

7. A method as claimed in claim 5, wherein the phase ($\phi$) and the frequency ($\omega$) for a random-access frame is the current phase ($\phi(0)$) and the current frequency ($\omega(0)$).

8. An audio encoder arranged to process a respective set of sampled signal values for each of a plurality of sequential time segments, the encoder comprising;

an analyzer for analyzing the sampled signal values to determine one or more sinusoidal components for each of the plurality of sequential segments;

a linker for linking sinusoidal components across a plurality of sequential segments to provide sinusoidal tracks, each track comprising a number of frames;

means for providing an encoded signal (AS) including sinusoidal codes ($C_s$) comprising a representation level (r) for zero or more frames and where some of these codes ($C_s$) comprise a phase ($\phi$), a frequency ($\omega$) and a quantization table (Q) for a given frame when the given frame is designated as a random-access frame, wherein each quantization table (Q) is represented by an index (IND) and where the index (IND) is transmitted from the encoder (1) to the decoder (3) at a random-access frame (702) instead of transmitting the quantization table (Q).

9. An audio player comprising:

means for receiving a signal including the encoded audio stream (AS'), the audio stream (AS') comprising tracks of sinusoidal codes ($C_s$), where the sinusoidal codes ($C_s$) comprises a representation level (r) for zero or more frames and where some of these codes ($C_s$) comprise a phase ($\phi$), a frequency ($\omega$) and a quantization table (Q) for a given frame when the given frame is designated as a random-access frame, wherein each quantization table (Q) is represented by an index (IND) and where the index (IND) is transmitted from an encoder to the means for receiving at a random-access frame instead of transmitting the quantization table (Q), and a synthesizer arranged to employ the zero or more received representation levels and the received phase ($\phi$), frequency ($\omega$) and quantization table (Q) for a given frame when the given frame is designated as a random-access frame in order to synthesize the sinusoidal components of the audio signal (y(t)).

10. An audio system comprising:

an analyzer for analyzing the sampled signal values to determine one or more sinusoidal components for each of the plurality of sequential segments;

a linker for linking sinusoidal components across a plurality of sequential segments to provide sinusoidal tracks, each track comprising a number of frames;

means for providing an encoded signal (AS) including sinusoidal codes ($C_s$) comprising a representation level (r) for zero or more frames and where some of these codes ($C_s$) comprise a phase ($\phi$), a frequency ($\omega$) and a quantization table (Q) for a given frame when the given frame is designated as a random-access frame;

means for receiving a signal including the encoded audio stream (AS'), the audio stream (AS') comprising tracks of sinusoidal codes ($C_s$), where the sinusoidal codes ($C_s$) comprises a representation level (r) for zero or more frames and where some of these codes ($C_S$) comprise a phase ($\phi$), a frequency ($\omega$) and a quantization table (Q) for a given frame when the given frame is designated as a random-access frame, wherein each quantization table (Q) is represented by an index (IND) and where the index (IND) is transmitted from the means for providing to the means for receiving at a random-access frame instead of transmitting the quantization table (Q), and a synthesizer arranged to employ the zero or more received representation levels and the received phase ($\phi$), frequency ($\omega$) and quantization table (Q) for a given frame when the given frame is designated as a random-access frame in order to synthesize the sinusoidal components of the audio signal (y(t)).

11. A storage medium including an audio stream comprising sinusoidal codes ($C_s$) representing tracks of sinusoidal components linked across a plurality of sequential time segments of an audio signal, where the sinusoidal codes ($C_s$) comprises a representation level (r) for zero or more frames and where some of these codes ($C_s$) comprise a phase ($\phi$), a frequency ($\omega$) and a quantization table (Q) for a given frame when the given frame is designated as a random-access frame, wherein each quantization table (Q) is represented by an index (IND) and where the index (IND) is transmitted from an encoder to a decoder at a random-access frame instead of transmitting the quantization table (Q).

* * * * *